United States Patent [19]

Morris

[11] 4,003,553

[45] Jan. 18, 1977

[54] GUARDRAIL POST ASSEMBLY

[75] Inventor: Paul L. Morris, Kansas City, Mo.

[73] Assignees: Sellers & Marquis Roofing Company; A. J. Shirk Roofing Company, Inc.; Western Roofing Company, Incorporated; Quality Roofing Company, Incorporated, all of Kansas City, Mo.

[22] Filed: Nov. 14, 1975

[21] Appl. No.: 631,918

[52] U.S. Cl. ..... 256/59; 256/65

[51] Int. Cl.[2] ..... E04H 17/14

[58] Field of Search ..... 256/59, 65, 11; 248/221, 223, 237; 182/113; 52/707

[56] References Cited

UNITED STATES PATENTS

| | | | |
|---|---|---|---|
| 3,480,257 | 11/1969 | Bourn et al. | 256/59 |
| 3,584,839 | 6/1971 | Dickey | 256/59 |
| 3,901,481 | 8/1975 | Probst | 256/59 |

*Primary Examiner*—Werner H. Schroeder
*Assistant Examiner*—Doris L. Troutman
*Attorney, Agent, or Firm*—Schmidt, Johnson, Hovey & Williams

[57] ABSTRACT

A low-cost, movable guardrail post especially adapted for temporarily supporting safety railings during roofing work and the like is provided which is braced against unintentional tipping for insuring that the integrity of the safety railing is maintained at all times. In preferred forms the post includes a concrete base having an upright steel post member detachably mounted thereon, with a pair of elongated bracing arms connected to the assembly and extending to a point adjacent the support surface and being coupled to a pair of metal stick clips secured to the support surface; in this manner the posts can be quickly mounted adjacent a roof edge, for example, by partially burying the stick clips under a layer of roofing asphalt or pitch and operatively coupling the brace members thereto. When the roofing work is completed, the guardrail posts can be removed by trimming the upstanding portions of the stick clips and transporting the concrete blocks and posts to another work site.

6 Claims, 6 Drawing Figures

GUARDRAIL POST ASSEMBLY

This invention relates to movable guardrail post assemblies which are especially adapted for temporarily supporting a safety guardrail around elevated construction sites such as roofing installations or the like. More particularly, it is concerned with guardrail posts of the type which are effectively braced against tipping for insuring that the guardrailing adequately protects workers and others in the vicinity of the work site, notwithstanding the fact that the post assemblies can be easily and quickly installed and removed for reuse.

In all types of industry today there is an ever-increasing concern for the safety of workers. This is reflected in newly promulgated governmental safety regulations which cover a wide variety of work situations. For example, it is now the practice to provide temporary safety guardrails around the edge of elevated work sites such as roofs, either during the construction or repair thereof. As can be appreciated, such guardrails are intended to minimize the possibility of a worker accidentally falling from the roof during the normal course of work around the edge thereof.

It will also be apparent that to be effective, such guardrails must be supported by post assemblies capable of withstanding cantilever loads and other forces which can tend to tip or upset the posts. This structural problem is of course compounded in the case of posts which are simply placed adjacent the edge of a roof as a temporary support for the guardrail. In such cases it is difficult to provide adequate structural support for the posts without positively securing the same to the roof itself. This latter expedient is objectionable in most instances since this tends to lessen the integrity of the roof after the guardrailing is removed.

It is therefore the most important object of the present invention to provide a guardrail post which can be movably positioned on an elevated surface such as a rooftop for supporting a guardrail or other fencing element, and which is braced against tipping or overturning by means of structure which can be shiftably positioned on the roof without fear of piercing or otherwise harming the latter.

A further object of the invention is to provide a guardrail post of the type including a base and an upstanding post member mounted thereon, with means for bracing the post assembly against tipping or overturning which includes a brace member extending between the post assembly and a point adjacent the support surface, with hold-down means coupled to the brace means and secured to the support surface; in preferred forms, a pair of metal stick clips are secured to a roof surface by partially submerging the same in a layer of roofing asphalt or pitch material, with the stick clips being operatively coupled to the brace members of the post assembly for preventing tipping of the latter.

Finally, another object of the invention is to provide a guardrailing including a plurality of spaced guardrail posts of the type described, and having at least one elongated fencing element extending between the guardrail posts for defining a safety guardrail around the edge of an elevated work surface such as a roof; in addition, a safety kickboard is also provided which is inboard of the fencing element for warning workers and others of the presence of the guardrailing.

Figure 1:
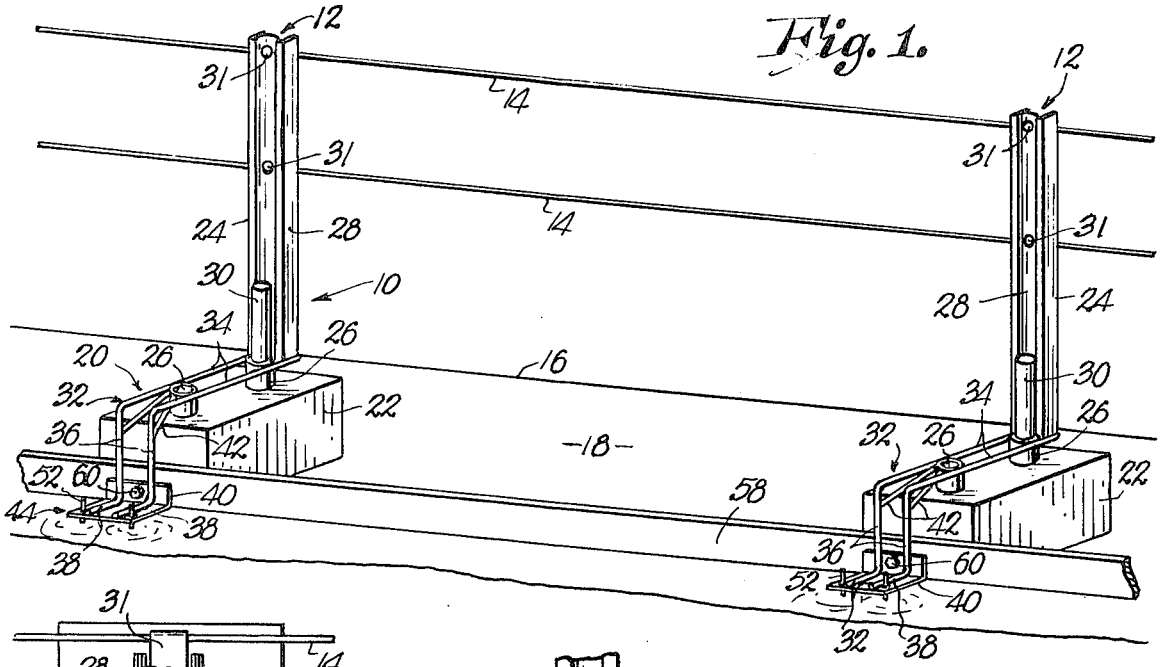
FIG. 1 is a perspective view of a guardrail assembly mounted adjacent the edge of a roof construction and depicting the use of a pair of spaced guardrail posts in accordance with the invention for supporting a pair of vertically spaced fencing cables extending therebetween.

A guardrail assembly 10 is illustrated in FIG. 1 and broadly includes a plurality of spaced, shiftable guardrail posts 12 which support a pair of vertically spaced, transversely extending metallic cables 14 which define an upright guardrail. In the form of the invention illustrated in FIG. 1, assembly 10 is positioned adjacent the edge 16 of a roof structure 18 under construction so that workers and others in the vicinity of edge 16 are prevented from inadvertently falling.

In more detail, each guardrail post 12 includes a post assembly 20 having a poured concrete block base 22 and an upright post member 24 detachably mounted thereon. In this regard, a pair of spaced, post member-receiving pipes 26 are embedded within block 22 and extend upwardly from the upper surface thereof, while a silicon or other type of parting agent is applied to the lower surface of the block. Each post member 24 includes an elongated metallic rail 28 having a lowermost pipe section 30 welded or otherwise securely affixed thereto. As shown in the drawing, pipe 30 is dimensioned to snugly fit within either of the upstanding pipes 26 so that rail 28 is supported in the necessary upright disposition; in addition, the connection between pipe 26 and rail 28 is completed by provision of a conventional set screw provided in the pipe 26. Conventional couplers 31 are also provided on the rails 28 for supporting the cables 14.

Each guardrail post 12 also includes brace means 32 in the form of a pair of spaced, adjacent, identical metallic members 34 which are welded to opposite sides of each pipe 26 and include depending leg portions 36 which extend toward roof structure 18 and terminate in short, laterally extending base portions 38. An apertured bracket 40 is welded to the underside of the portions 38 of the brace members 34 in order to interconnect and rigidify the latter. Finally, a pair of angled braces 42 extend between depending leg portions 36 of the respective brace members and the adjacent upstanding pipe 26.

Figure 6:
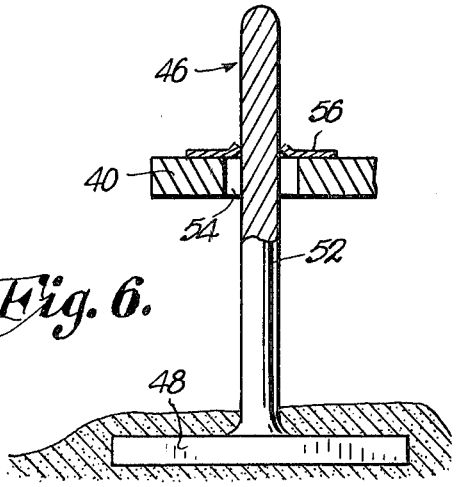
FIG. 6 is an enlarged, fragmentary view in partial vertical section of one of the hold-down stick clips utilized in the invention and shown operatively coupled to the bracing structure of one of the guardrail posts.

Hold-down means 44 is also provided with each guardrail post 12 in order to prevent tipping or overturning of the latter. In preferred forms, means 44 comprises a pair of spaced, identical stick clips 46 (see FIG. 6) which include a planar base portion 48 and an integral, upstanding, central leg or extension 52. As shown in the drawing, the respective extensions 52 of a pair of adjacent clips are received within respective apertures 54 provided in bracket 40. In addition, coupling means in the form of a frictional clip 56 secured adjacent each aperture 54 is provided for frictionally engaging a respective extension 52 and coupling the stick clips to brace means 32. As best shown in FIG. 6, the bases 48 of each clip 46 are specially adapted for submersion in a layer of asphalt material in order to secure the overall post assemblies 12 in place.

Figure 2:
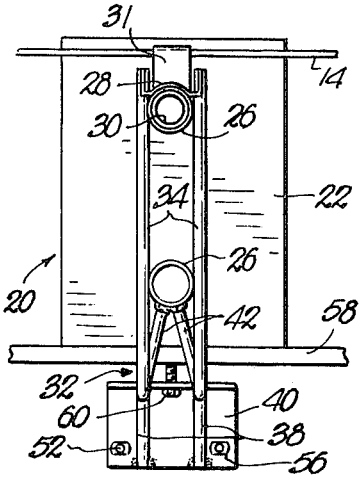
FIG. 2 is a fragmentary plan view of the guardrail assembly illustrated in FIG. 1 and depicting in detail one of the guardrail posts.
Figure 3:
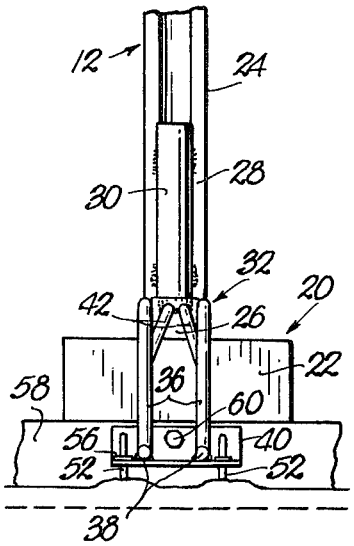
FIG. 3 is a fragmentary, front elevational view of one of the guardrail posts illustrated in FIG. 1.
Figure 5:
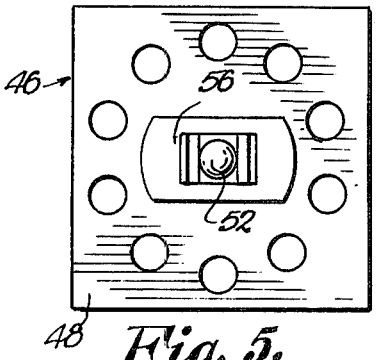
FIG. 5 is an enlarged plan view of one of the hold-down stick clips employed in the invention for securing the guardrail posts against overturning.
Figure 4:
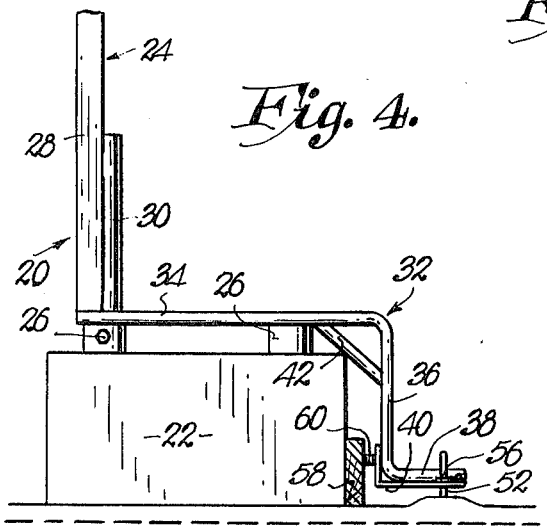
FIG. 4 is a fragmentary, side elevational view of one of the guardrail posts shown in FIG. 1.

An elongated safety kickboard 58 completes the guardrail assembly 10 and as shown in FIG. 1, extends between the spaced guardrail posts 12. Securement of kickboard 58 is accomplished by provision of a bolt 60 extending through the upturned section of each bracket 40 and engaging the forward face of the kickboard. This serves to press kickboard 58 into engagement with the adjacent faces of the respective concrete block bases 22 as best illustrated in FIGS. 2 and 4.

In use, guardrail assembly 10 can be quickly set up adjacent the edge of a roof structure as shown in FIG. 1. For example, in the case of so-called "built-up" roofs, a plurality of guardrail posts 12 can be positioned adjacent the edge thereof with the bases 48 of the clips 46 being covered by a layer of asphalt or pitch material. This serves to securely hold the posts 12 in position against tipping or overturning even in the event of a worker accidentally falling against cables 14. However, the latter is in large measure prevented by virtue of kickboard 58 which as shown is preferably positioned inboard of the cables 14. Thus, if a worker unknowingly approaches the edge 16 of roof structure 18, he first encounters kickboard 58 which is a warning of the presence of assembly 10 and thus the edge of the roof.

When it is desired to remove assembly 10 from a roof or the like, it is only necessary to trim the extensions 52 of the respective clips 46 without removal of the bases 48 thereof, whereupon the posts 12 can be shifted to another work site as needed. Any remaining upstanding portions of the extensions 52 can then be covered by asphalt or the like so that the integrity of roof structure 18 is maintained.

It will thus be seen that the present invention provides a guardrail assembly which can be quickly and easily mounted upon a roof structure or other elevated work site in order to provide a safety function for workers or others in the vicinity thereof. Moreover, the unique hold-down structure provided with the invention ensures that the guardrail assembly is secured against tipping or overturning without the necessity of piercing the roof structure or the like or otherwise permanently injuring the same.

Having thus described the invention, what is claimed as new and desired to be secured by Letters Patent is:

1. A guardrail post, comprising:

a post assembly including a movable base comprising a block formed of concrete adapted for shiftable positioning on a support surface, a pair of spaced, post member-receiving pipe members secured to said block and extending upwardly from the upper surface thereof, and an upright post member mounted on said base and received by one of said pipe members; and means for preventing tipping of said post assembly, including brace means secured to said post assembly and extending to a point adjacent said support surface, said brace means comprising a pair of spaced, adjacent, generally parallel metallic members each secured to said pipe members and having depending sections extending towards said support surface, with apertured bracket means interconnecting said depending sections adjacent said support surface;

hold-down means temporarily secured to said support surface adjacent said point thereon and comprising a pair of adjacent stick clips each having an upright extension thereon, said extension being received within respective apertures in said bracket means; and means operatively coupling said brace means and hold-down means for preventing tipping of said guardrail post, said coupling means comprising a clip secured to said bracket means adjacent each of said extension-receiving apertures for releasably holding the extensions therein.

2. The guardrail post as set forth in claim 1, including means detachably mounting said post member on said base.

3. The guardrail post as set forth in claim 1, wherein said stick clips are formed of metallic material and are adapted for partial submersion in asphalt or the like applied to said support surface.

4. A guardrailing comprising:

a plurality of spaced guardrail posts adapted for movable positioning on a support surface, each of said guardrail posts comprising:

a post assembly including a movable base and an upright post member mounted on said base; and means for preventing tipping of said post assembly, including brace means secured to said post assembly and extending to a point adjacent said support surface;

hold-down means temporarily secured to said surface adjacent said point thereon; and means operatively coupling said brace means and hold-down means for preventing tipping of said guardrail posts;

at least one elongated fencing element supported by said post members and extending between said guardrail posts; and a kickboard extending along said support surface adjacent the bases of said post assemblies.

5. The railing as set forth in claim 4, wherein said post members and the fencing element supported thereby are spaced from said kickboard.

6. The railing as set forth in claim 4, wherein a pair of vertically spaced, elongated cables extend between said post members and are connected to each of the latter.

* * * * *